US005300008A

United States Patent [19]

Lee et al.

[11] Patent Number: 5,300,008

[45] Date of Patent: Apr. 5, 1994

[54] PRINTER AND FOLDER WITH CHAINS HAVING LIGHT WEIGHT PENDANTS HANGING THEREFROM

[75] Inventors: Ho C. Lee, Endicott; Larry T. Sehringer, Vestal; Gary D. VanBurger, Owego, all of N.Y.

[73] Assignee: International Business Machines Corporation, Armonk, N.Y.

[21] Appl. No.: 938,183

[22] Filed: Aug. 31, 1992

[51] Int. Cl.[5] ..... B65H 45/20; B65H 45/101

[52] U.S. Cl. ..... 493/320; 493/410; 493/448; 400/613.2

[58] Field of Search ..... 493/410, 411, 413, 447, 493/448, 320; 400/613.2, 613.3

[56] References Cited

U.S. PATENT DOCUMENTS

| | | | |
|---|---|---|---|
| 2,779,450 | 1/1957 | Mecum et al. | 400/613.2 |
| 2,906,527 | 9/1959 | Blain | 493/411 |
| 4,054,235 | 10/1977 | Witcher | 493/410 |
| 4,559,031 | 12/1983 | Gysling et al. | 493/410 |
| 5,123,894 | 6/1992 | Bergeman et al. | 493/410 |

FOREIGN PATENT DOCUMENTS

| | | | |
|---|---|---|---|
| 1288218 | 9/1972 | United Kingdom | 493/410 |
| 28398 | 2/1983 | Japan | 400/613.2 |

*Primary Examiner*—Edward K. Look
*Assistant Examiner*—John Ryznic
*Attorney, Agent, or Firm*—Michael E. Belk

[57] ABSTRACT

Tractor drives of a high speed printer move a length of continuous-form paper longitudinally up from a box of fanfold stacked paper, through a print mechanism and downward to refold onto a fanfold stack. A set of bead or link chains hang vertically from the printer on each respective major side of the descending paper. The chains are positioned to interact with the folding paper. The chains swing against the paper to aid in creasing the paper at the folds in the proper fanfold direction. One or more chains have pendants attached at the chain's lower swinging end. The pendants are sufficiently long, stiff and light weight to prevent the lower ends of the chains from getting caught in the refolding stack of paper which could lead to jamming the travel of paper through the tractor drives. Preferably, the pendants are produced from 7 inch long segments of approximately 25 mil. diameter piano wire, bent at mid length to form a wide tip loop that prevents the pendant from falling into sprocket holes along each longitudinal edge of the length of paper, and both ends of the wire loop are soldered to the lower end of the chain.

20 Claims, 4 Drawing Sheets

PRINTER AND FOLDER WITH CHAINS HAVING LIGHT WEIGHT PENDANTS HANGING THEREFROM

TECHNICAL FIELD

This invention relates to high speed continuous-forms printing and, in particular, to minimizing misfolding during refold stacking of the continuous-forms subsequent to printing.

BACKGROUND OF THE INVENTION

Information handling systems utilize high speed printers for rapidly generating printed information in a tangible form. High speed printers generally utilize xerographic or impact printing technologies. Impact printers are desirable for low cost and requested where the option to print multipart forms is desired. Printing mechanisms for impact printers generally transfers ink or other material from a print ribbon onto paper to form images on one major surface of the paper.

Continuous-form paper is usually supplied from a box in which the paper is stacked in a fan-fold pattern. The paper may be single layer or may be multi-layer to provide multi-part forms. Continuous-form paper is perforated along lateral lines to divide the continuous length into separable sheets or forms. Each of the separable sheets is rectangular and is typically 11.5 inches high by 14 and $\frac{7}{8}$ inches wide. The paper is folded along the perforations in a zigzag manner reminiscent of oriental hand fans in which each lateral perforation is folded in the opposite direction from the preceding fold to form a stack.

Tractor drives engage a longitudinal row of holes along each edge of the paper for moving the paper longitudinally from the source box of paper, through the printing mechanism and downward toward a horizontal surface upon which it refolds in an output stack of printed, continuous forms. The tractor drives tend to distort the paper at the tractor holes in the edges of the paper so the refold stack is bowed upward at the edges. Typically, the paper length remains slightly folded along the lateral perforations after unstacking and printing and the descending paper length naturally tends to refold onto the stack at each lateral perforation in the same direction that it was originally folded.

Since the introduction of fanfold paper refolding, practitioners have faced the problem that occasionally the paper will fail to refold along the lateral perforations in the proper direction. The misfolding results in a jumble of output and for enclosed printers often results in an output paper jam and loss of data. It is known that the misfolding and jamming are related to the bowing of the stack due to the damage of the sprocket holes by the tractor drive and to the height of the paper discharge above the top of the stack and is also related to the intermittent characteristics of feeding of the paper through the printer.

The longitudinal movement of the paper through the printer is not continuous. Usually the movements is stopped as each line is printed on the sheets. Also, the paper tends to move quickly through blank lines and even more quickly through blank pages. For a very high speed paper tractor, the paper output is often accelerated so that descending paper bends as it falls into the stack and fails to properly refold onto the stack.

Also, the printer does not usually operate continuously. The output typically consists of separate reports which are sent to the printer as desired so that the printer is idle for minutes or even for hours between jobs. In addition, information handling systems tend to be idle for long periods due to schedules of working shifts, weekends and holidays. The paper in the printer may be idle with a lateral perforation in a straightened configuration so as to forget the original fold direction at the perforation; or the paper may be idle in a bent configuration and retain the bend so that it does not properly refold onto the output stack.

Once the stack is started in the proper location with the continuous length of paper refolding in the previous fan-fold directions, proper refolding tends to continue without any additional aid. However, occasionally the paper fails to refold in the desired direction which produces an unfolded jumble of printed output, and eventually applies forces to the paper moving through the tractor. The tractor tears out the sprocket holes in the paper causing the paper to stop moving through the printer.

In an effort to further prevent these occasional output jams, and to aid in starting the stack in the proper position and folding in the correct direction, some printers have utilized chains hanging vertically down from the printer frame on each major side of the descending length of folding paper. Typically the lower ends of the chains hang between 0 and 4 inches above the horizontal surface upon which the paper is refolded. At the beginning of folding, the lower chains position the paper stack symmetrically about the center between the chains. The paper pushes the lower chains outward to swing, and the swinging chains sweep against the forms to aid in refolding the continuous length of paper.

However, these swinging chains result in another mechanism for causing paper jams. The lower ends of the chains become caught in the sprocket holes along the edge of the paper or become caught between the folding layers of paper as they sweep against the folding paper. The caught chain bows the paper stack resulting in misfolds which cause paper jams. Customers, recognizing this problem, have hung small paper clips from the lower ends of the chains to extend the chains so they don't swing in order to prevent these types of jams. However this defeats the purpose of the chains. A previous printer, designated 4235, marketed by International Business Machines Corporation provided swinging chains above the highest stack height and strings with weights hanging at the lower ends of the strings. In that printer the weights hang below the horizontal surface on which the paper is stacked. The weights remain below the top of the stack and the strings don't swing against the folding paper.

U.S. Pat. No. 2,779,450 to Mecum et al. discloses "an attachment for guiding continuous prefolded forms used in connection with form stands for accounting and typewriting machines." The apparatus includes weights suspended by extra fine wire such that "the weights and string means will swing in harmony with [the movement of] said forms." U.S. Pat. No. 4,054,235 to Witcher discloses "apparatus to separate multiple sheet feeds from fanfold paper being moved from an input paper stack upwardly to a print station." U.S. Pat. No. 4,559,031 to Gysling et al. dive arresters that are suspended by chains each "having a projecting ledge . . . that upon catching the diving fold [of paper] . . . swings in reaction to the weight of the paper and releases the diving fold when the outward swinging motion of the ledge has displaced the diving fold to a position from which the fold will fall substantially into alignment with folds of previously stacked pages." U.S. Pat. No. 5,123,894 to Bergeman discloses "the lower ends of the two flexible straps 22 and 24 are secured to the ends of the narrow plate or bracket member 44." An English abstract for Japanese patent J03047773 discloses "a rod-form member 9 is swingingly suspended by wire materials 8 . . . paper 2 delivered from a paper discharge port 1*a* of a printer 1 abuts on the rod-form member."

SUMMARY OF THE INVENTION

Accordingly, it is an object of this invention to provide a high speed continuous-forms printer which reliably and economically produces a refolded stack of printed fanfold output.

It is another object to provide a process for reliably and economically producing a refolded stack of printed continuous-forms fanfold output in a high speed printer.

It is another object of this invention to provide a printer with swinging chains for reliable fanfold stacking which do not get caught by the folding stack of paper.

It is finally object of the invention to prevent the lower ends of the swinging chains from getting caught in the sprocket holes of the refolding output paper of a printer.

In the applicant's invention the tractor drives of a high speed printer move a length of continuous-form paper longitudinally up from a box of fanfold stacked paper, through a print mechanism and downward for refolding onto a fanfold stack. A set of bead chains hang vertically from the printer on each major side of the descending paper. The chains are positioned to interact with the folding paper. The folds of the refolding paper hit the chains and the chains swing against the paper to aid in creasing the paper at the folds in the proper fanfold direction. The lower ends of the chains are provided with a longate, light weight, stiff pendant elements. The element is sufficiently long and light in weight so that the element is kicked out from under paper by the folded edges of the refolding paper. Also the lower tip of the element is shaped to prevent fitting into the sprocket holes along the lateral edges of the length of paper.

Other features and advantages of this invention will become apparent from the following detailed description of the presently preferred embodiment and alternative embodiments of the invention, taken in conjunction with the accompanying drawings.

DETAILED DESCRIPTION OF THE DRAWINGS

Figure 1:
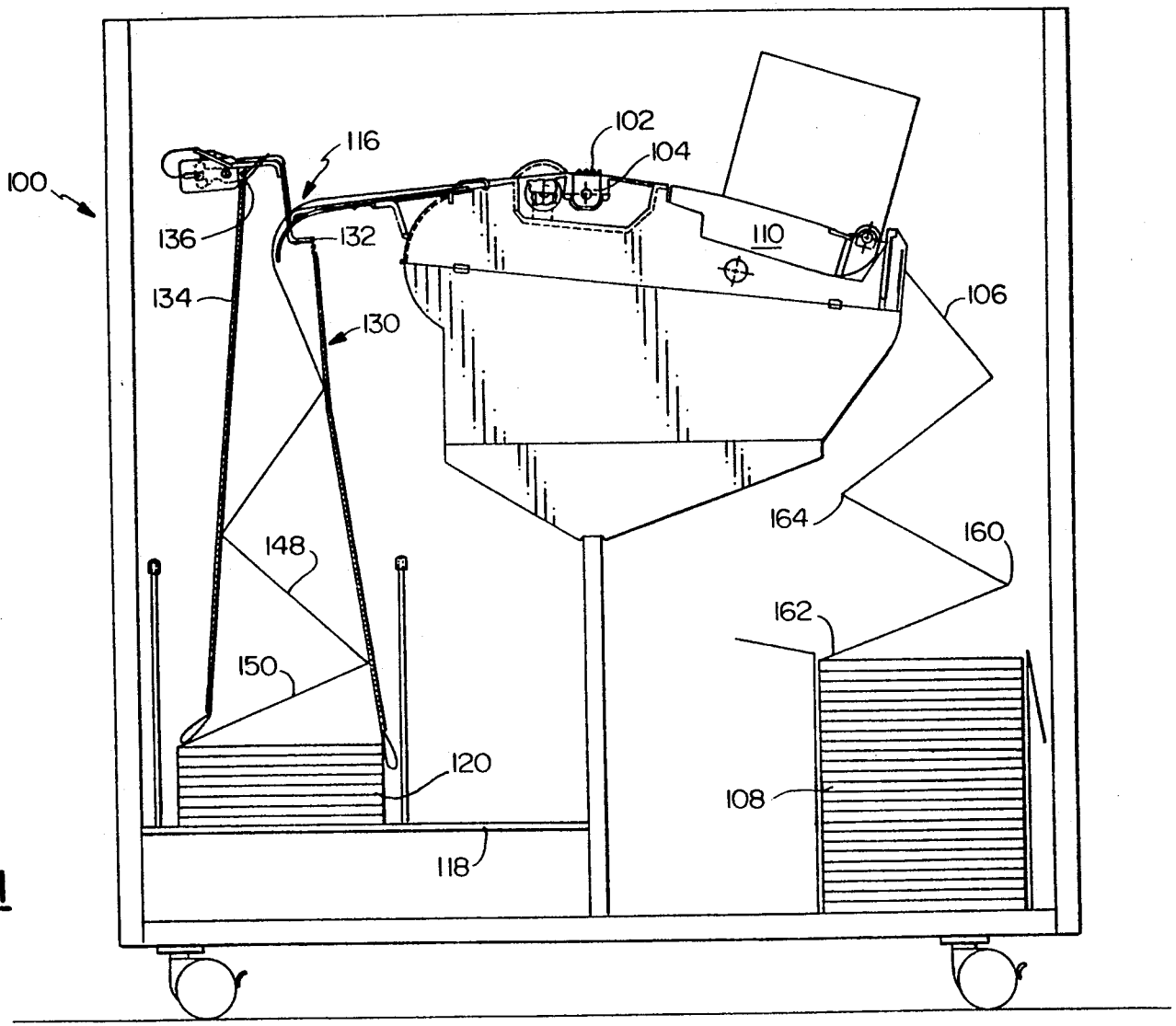
FIG. 1 schematically illustrates a side view of the printer of this invention with a set of swinging chains vertically hanging on each major side of the descending length of refolding paper, each chain having a pendant hanging at a lower end.

FIG. 1 shows printer 100 of the invention. Pins 102 of tractor drive 104 engage into sprocket holes (not shown) along each longitudinal edge of a continuous-form length 106 of paper, to move the continuous paper longitudinally from a source 108 of fanfold paper, through printing mechanism 110, and downward at 116 toward generally horizontal surface 118 onto which the paper refolds in the same fanfold pattern as in the source. A set of chains 130 on the front side 106 of paper hang vertically down from printer frame member 132; and similarly a set of chains 134 on the back side of the paper hang from printer frame member 136. The chains usually comprise hollow metal beads on a string or wire, or small interlocking links or any similar elongated member which does not catch the paper. The sets of chains interact with the folding length of paper.

At the beginning of folding, as shown, the chains 130 and 134 position the paper stack symmetrically about the center between the chains. The paper pushes the chains outward to swing and the swinging chains sweep against sheets 148 and 150 to aid in refolding the continuous length of paper.

Source 108 of paper may be, for example, a cardboard box containing a paper stack folded at perforations. The pattern of the folds is similar to the pattern used in hand held oriental fans in which each fold 160 is bent, as shown, in the opposite direction in relation to previous fold 162 and subsequent fold 164.

The printer of the invention may produced by using a kit to convert an existing printer. Swinging chains with the pendants hanging from the lower ends may be supplied for the existing printer which are attached to the printer to produce a printer of the invention.

Figure 2:
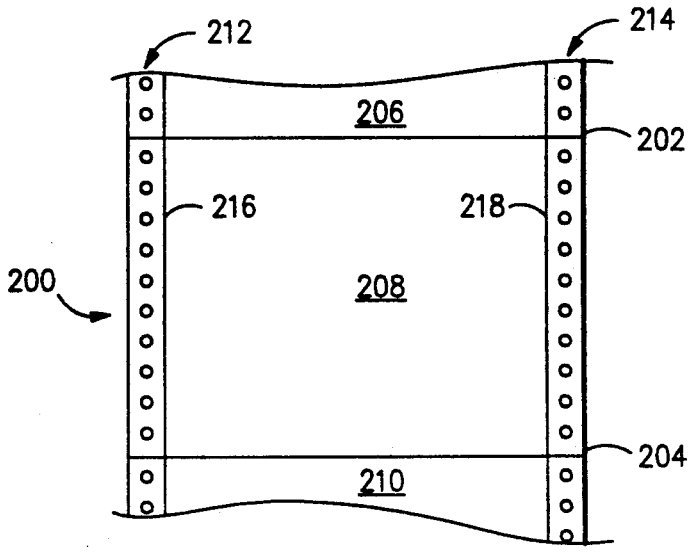
FIG. 2 shows a section of a major surface of the continuous-form length of paper of FIG. 1 with a longitudinal row of sprocket holes along each lateral edge.

FIG. 2 illustrates a section of a major surface of the continuous-form length 200 of the paper of FIG. 1. The continuous length of paper is divided laterally by linear perforations 202 and 204 into sheets or forms 206, 208 and 210 which can be separated into single sheets by tearing along perforations 202 and 204. Rows of holes 212 and 214 along each lateral edge of the length of paper interact with tractor drives as described above. Typically, longitudinal perforations 216 and 218 are provided for removing the edge holes from the printed reports.

Figure 3:
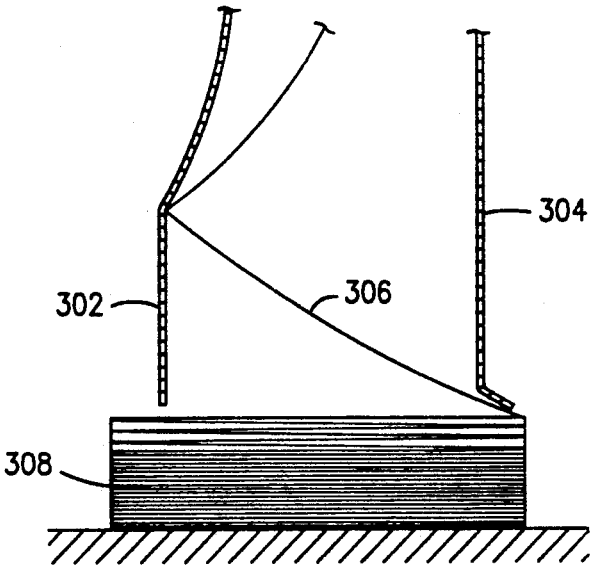
FIGS. 3 through 5 show a side view of swinging chains interacting with the refolding output stack of a printer which do not use the invention of applicant.
Figure 4:
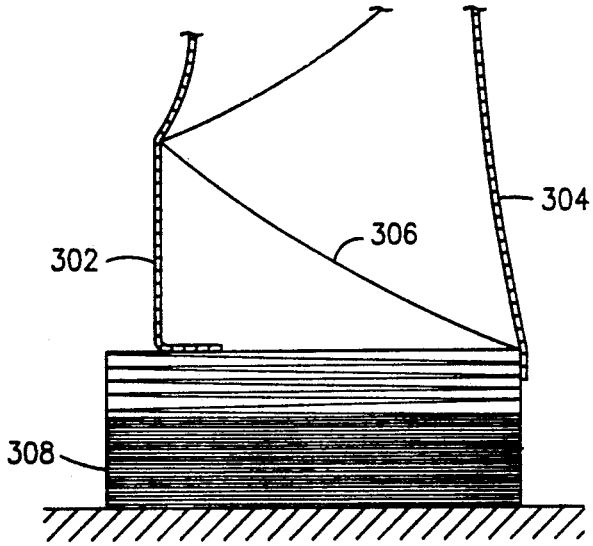
Figure 5:
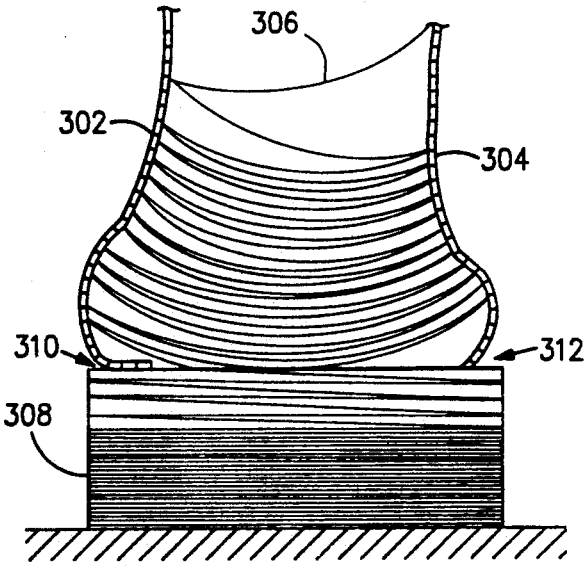

FIGS. 3 through 5 illustrate the interaction in the printer output area between chains 302 and 304 and length of refolding paper 306. The chains do not use the pendants of the printer of this invention. In FIGS. 3 and 4 the chains are swinging to sweep against the paper to aid in folding the paper. In FIG. 3 the ends of the chains are at the same level or above the top of stack 308, but in FIG. 4, as the stack height increases, the chains are positioned to lay on top of the stack of paper. In FIG. 4 the folds of paper hit the chains and kick the lower end of the chains off the top of the stack so the paper is not accumulating on top of the chains. If a few sheets of paper are able to accumulate on top of an end of the chain then the impact of the folds will not be sufficient to kick the chain out of the stack. Also, if the end of the chain is dragged across a sprocket hole it may become trapped in the hold. In FIG. 5, at 310, the lower end of chain 302 is caught under the stack of paper, and at 312, the lower end of chain 304 is caught in a sprocket hole (shown in FIG. 2). The chains have become taunt as the paper accumulates and pushes the chains outward, and the paper curls up against the chains. The paper misfolds and becomes jumbled and it may eventually jam the movement of paper through the printer.

Figure 6:
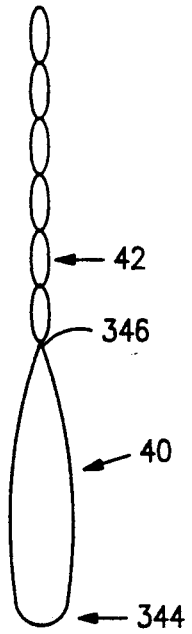
FIG. 6 shows the preferred embodiment of the chains with pendants of the printer of this invention.

FIG. 6 shows a longate, stiff, light weight pendant 40 hanging from the lower end of swinging chain 42 of the printer of the invention. Preferably the pendant is more than 1 inch in length and more preferably from 2 to 8 inches long and most preferably about 3.5 inches long. The lower end of the wire loop at 344 has a diameter larger than the diameter of the sprocket holes along the edges of the length of paper which is typically about 0.2 inches. The wire is sufficiently light to allow the paper to push the chain off the stack and sufficiently stiff so that it doesn't bend to lay flat between the sheets of paper in the stack. Preferably, the loop is fabricated from metal wire from 10 to 100 mil in diameter and more preferably from piano wire of about 25 mil. diameter. The wire is at least 2 inches long and preferably from 4 to 16 inches long to produce a 2–8 inch long pendant; more preferably, the wire is 7 inches long for producing a pendant approximately 3.5 inches long. In this embodiment, both ends of the wire are connected to the lower end of the chain at 346, preferably by soldering, to provide a smooth joint which doesn't catch the edges of the paper.

Hollow heat-shrink tubing (not shown) was also tried. The tubing was large enough so that it wouldn't go into the sprocket holes, but the plastic tubing was too heavy and insufficiently stiff so that it tended to get caught between the folding sheets of paper in the stack.

Figure 7:
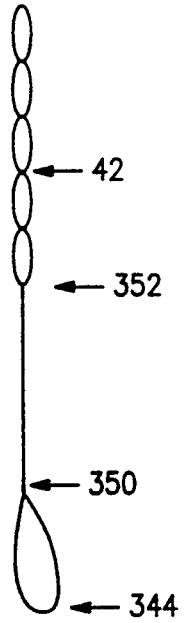
FIG. 7 shows an alternate embodiment of the chains with pendants of the printer of this invention.
Figure 8:
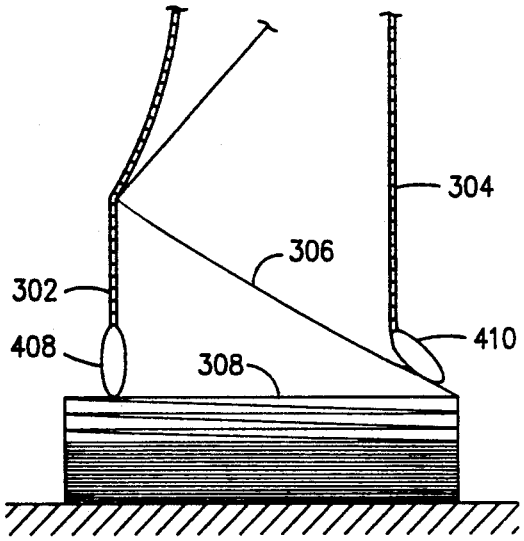
FIGS. 8 through 10 show a side view of the swinging chains interacting with the refolding output stack of the printer of this invention.
Figure 9:
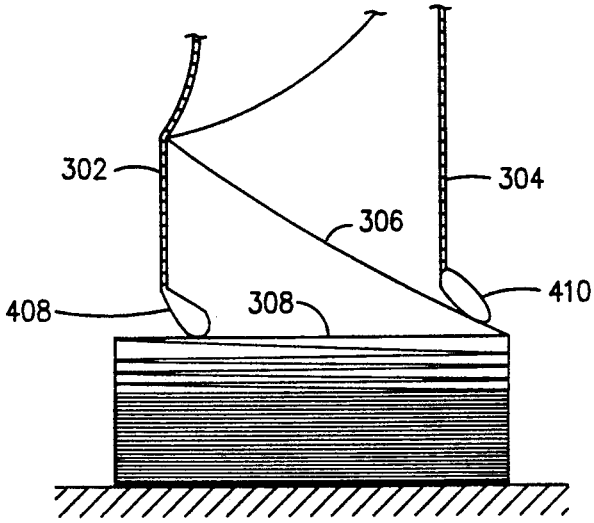
Figure 10:
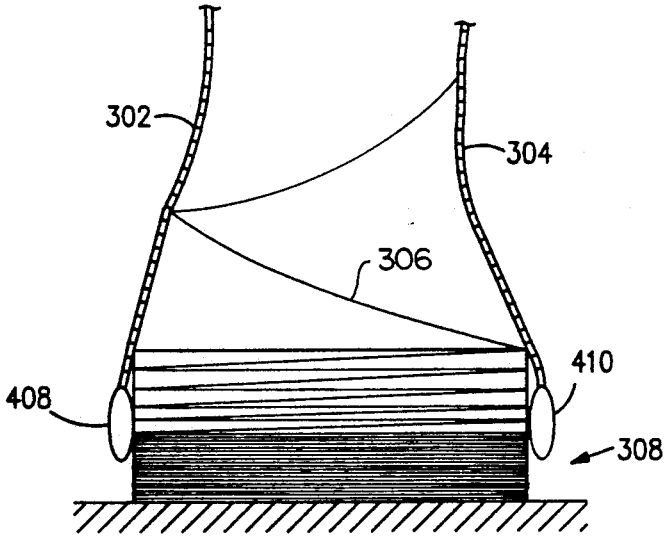

FIG. 7 shows another embodiment of the invention which uses less wire length, but the wire has to be of larger diameter and two joints at 350 and 352 are required for manufacture. This pendant embodiment has the same preferred length as the embodiment of FIG. 7 and the radius of the wire loop at 344 is too large to fit into sprocket holes of the continuous paper. FIGS. 8 through 10 depict the perfect stacking provided by the printer invention of applicant. In FIGS. 8 and 9, chains 302 and 304 and pendants 408 and 410 are interacting with folding length 306 of paper to aid in folding. In FIG. 9, as the height of the stack 308 increases, the stiff element is not bent by the paper and is kicked out of the stack by the weight of paper and the force of the paper against the chain. In FIG. 10, as the height of the stack continues to increase, loops 408 and 410 lay statically over the edges of stack 308.

While the currently preferred embodiment of this invention has been illustrated and described, various changes and modifications may be made therein within the scope of this invention which is defined by the following claims.

What is claimed is:

1. A printer comprising in combination:

means for supplying a length of continuous form paper which is prefolded laterally along linear perforations which connect between sheets;

printing means for producing images on the surface of the length of paper;

tractor means for moving the length of paper longitudinally through the printing means and downward onto a fanfold stack after printing;

surface means for stacking the perforation connected paper sheets thereon in a fanfold arrangement;

frame means for positioning and supporting chain means along each major side of the descending length of paper;

chain means including chains hanging from said frame means on each major side of the length of paper to interact with the folding paper to sweep the chains against the paper for minimizing misfolding and which have a lower end and which are of a length for the lower ends to lay on the top of the stack at times during stacking; and means for preventing the lower ends of the chains which lay on the stack from becoming trapped in the folding paper including long, stiff, light weight pendants, each pendant attached to the lower end of one chain for hanging from the end of the chain to prevent the chain from being caught in the refolding stack of paper to prevent misfolding, output jumbling, and eventual jamming of paper movement through tractor means.

2. The printer of claim 1 in which each pendant includes, a wire bent to form a loop with both ends of the wire soldered to the lower end of the chain from which the pendant hangs.

3. The printer of claim 2 in which the wire is from 10 mil to 100 mil thick metal wire.

4. The printer of claim 3 in which the wire is approximately 25 mil thick piano wire.

5. The printer of claim 1 in which the pendant is more than 1 inch long.

6. The printer of claim 5 in which the pendant is from 2 to 8 inches long.

7. The printer of claim 6 in which the pendant is approximately 3.5 inches long.

8. The printer of claim 1 in which each pendant includes, an approximately 25 mil segment of piano wire approximately 7 inches long bent at mid length to form a loop with both ends of the wire soldered to the lower end of the chain from which the pendant hangs.

9. A kit to convert an existing printer into the printer of claim 1, comprising in combination:

means for attaching chains to the existing printer to hang on each major side of a descending length of paper;

two or more chains for hanging on each major side of the descending length of paper, and which have a lower end and which are of a length for the lower end to lay on the top of the stack at times during stacking; and means for preventing the lower ends of the chains which lay on the stack from becoming trapped in the folding paper including long, stiff, light weight pendants, each attached to one chain for hanging from the lower end of the chain to which the pendant is attached to prevent the chain from being caught in the refolding stack of paper.

10. The kit of claim 9 in which each pendant includes, a wire bent to form a loop with both ends of the wire soldered to the lower end of the chain from which the pendant hangs.

11. The kit of claim 9 in which the pendant is more than 1 inch long.

12. The kit of claim 11 in which the pendant is from 2 to 8 inches long.

13. The kit of claim 12 in which the pendant is approximately 3.5 inches long.

14. The kit of claim 10 in which the wire is from 10 mil to 100 mil thick metal wire.

15. The kit of claim 14 in which the wire is approximately 25 mil thick piano wire.

16. A fanfold paper stacker, comprising in combination:

surface means for stacking the perforation connected paper sheets thereon in a fanfold arrangement;

frame means for positioning and supporting chain means along each major side of the descending length of paper;

chain means including chains hanging from said frame means on each major side of the descending length of paper to interact with the folding paper to sweep the chains against the paper for minimizing jamming and which have a lower end and which are of a length for the lower end to lay on the top of the stack at times during stacking; and means for preventing the lower ends of the chains which lay on the stack from becoming trapped in the folding paper including long, stiff, light weight pendants, each attached to one chain for hanging from the lower end of the chain to prevent the ends of the chains from being caught in the refolding stack of paper.

17. The paper stacker of claim 16 in which each pendant includes:

a piano wire approximately 7 inches long and approximately 25 mil thick, having a bend with a radius of at least 0.1 inch to form an long loop with both ends of the wire soldered to the lower end of the chain.

18. A printing process comprising the steps:

supplying a length of stacked continuous form paper which is prefolded laterally along linear perforations which connect between sheets;

printing images on the surface of the length of paper;

moving the length of paper longitudinally from the supply stack through printing means and downward onto a fanfold stack after printing;

refolding the perforation connected paper sheets into a stack on a surface in a fanfold arrangement;

positioning multiple chains hanging along each major side of the descending length of paper to interact with the folding paper to sweep chains against the paper for minimizing jamming; and preventing a lower end of chains from becoming trapped in the folding paper including attaching long, stiff, light weight pendants to hang from the lower ends of the chains to prevent the chains from being caught in the refolding stack of paper.

19. The printing process of claim 18 further including the pendant forming steps of:

cutting a continuous spool of from 10 to 100 mil thick metal wire into segments more than 2 inches long;

bending each segment of wire at mid-length with a radius of at least 0.1 inches; and for each bent, wire segment, attaching each end of the segment to the same lower end of a chain.

20. The printing process of claim 19 in which the lengths are cut approximately 7 inches long from approximately 25 mil piano wire and are attached to the chain by soldering to form a smooth joint.

* * * * *